US006651475B1

(12) United States Patent
O'Donnell et al.

(10) Patent No.: US 6,651,475 B1
(45) Date of Patent: Nov. 25, 2003

(54) TUBE BENDING APPARATUS

(75) Inventors: Michael J. O'Donnell, Avon, OH (US); Richard D. Cook, Avon, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 0 days.

(21) Appl. No.: 10/138,988

(22) Filed: May 3, 2002

(51) Int. Cl.[7] ..... B21D 7/024
(52) U.S. Cl. ..... 72/157; 72/219; 72/478
(58) Field of Search ..... 72/149, 150, 153, 72/157, 158, 159, 212, 213, 217, 218, 219, 388, 478

(56) References Cited

U.S. PATENT DOCUMENTS

| | | | | | |
|---|---|---|---|---|---|
| 343,962 | A | * | 6/1886 | Mack | 72/219 |
| 5,187,963 | A | | 2/1993 | Sutton, Jr. et al. | |
| 5,284,041 | A | | 2/1994 | Christenssen et al. | |
| 5,337,590 | A | * | 8/1994 | Schuchert et al. | 72/157 |

FOREIGN PATENT DOCUMENTS

| | | | | |
|---|---|---|---|---|
| FR | 2 427 147 | * | 2/1980 | 72/478 |

* cited by examiner

*Primary Examiner*—Lowell A. Larson
(74) *Attorney, Agent, or Firm*—Watts Hoffmann Co.

(57) ABSTRACT

Apparatus and method for producing bends in tubes, including a bending die assembly having a fixed die section that is rigidly mounted to a support member and at least one a movable die section that is movable relative to the fixed section. When used to make "wrinkle" bends the die assembly includes a pair of moveable die section that are moveable relative to the fixed die section and relative to each other along a predetermined path. The movable die section or sections are supported for movement in a common plane and include camming pins engageable with slots formed in the support member, such that the engagement of the pins with the associated slots define paths of movement for the die sections. When used to make "wrinkle" bends, the fixed die section and movable die sections define wrinkle receiving recesses. After a bend has been made in the tube, the movable die sections move in an advancing direction and towards each other in order to disengage the inside of the bent tube and are then moved to a retracted position, in order to perform a subsequent bend step. In an alternate embodiment, the die assembly includes a fixed section and a single movable section and is intended to perform mandrel type bends. In this alternate embodiment, at the conclusion of a bending step, the movable die section is advanced and moves towards a centerline, thereby disengaging the inside of the tube and allowing the tube to be rotated about its axis in order to position another portion of the tube for a subsequent bend.

11 Claims, 9 Drawing Sheets

TUBE BENDING APPARATUS

TECHNICAL FIELD

The present invention relates generally to pipe bending and, in particular, to a method and apparatus for bending thin wall tubing.

BACKGROUND ART

Thin wall tubing has been used for automobile exhaust systems for some time and, more recently has been used in heat exchangers for gas fired heating appliances. In the case of exhaust systems, the tubing is bent into a configuration to fit within the spaces available below the vehicle. In the case of heat exchangers, typically bends greater than 120° are used to create the serpentine shape. In either case, when bends exceed 120°, the tube is commonly "mandrel" bent in that the tubing is bent around a forming guide while a mandrel is pulled through the inside of the tube to keep a consistent inside diameter and to prevent it from collapsing.

More recently, a technique of bending tubing using "control wrinkle" has been used. In this method, the bend die is made with a series of grooves around the inside of the bend radius, which allows the tubing material on the inside of the radius to "wrinkle up" in a controlled manner. This wrinkling substantially reduces excessive stretching of the material on the outside of the bend. With this more recent technique, tubing can be bent without collapsing the walls and without the use of an internal mandrel when tubing is bent more than 120 degrees.

The main disadvantage of this bending technique is that when angles exceed 90 degrees, the tubing becomes locked onto the bend die because the wrinkles in the tube engage and then are held by the grooves formed in the die. In prior constructions, the tube is released from the bend die by splitting the die so that the upper and lower halves of the die or portions thereof move apart, i.e., along a line of movement that is parallel to the rotational axis about which the tube was bent.

Tubes intended to be used as part of heat exchangers and gas fired heating products are generally serpentine in configuration and include multiple bends. In some designs, the bends in a tube are "offset" with respect to each other. In order to achieve the offset bend, the tube must be rotated about its axis prior to making the subsequent bend. In the type of bending apparatus in which the bend die is split along a plane orthogonal to the axis about which the tube is bent, on subsequent bends the tooling interferes and prevents the translational movement required to reposition the tube for the next bend. In particular, in order to release the tube from the bend die, the upper half of the die moves upwardly away from the lower half of the die. When in its upper, released position, there is not sufficient room for the bent end of the tube to rotate past the upper die segment and after the second bend or on subsequent bends to translate to the next bend position. Interference may exist between the die and the tube which prevents rotation to the next bend plane. One suggested method for resolving the interference is to provide a tube bender with a "head shift" capability. This solution adds to the complexity of the bending machine and is expensive. By axially shifting the "bend head" of the bender, the bend die is repositioned out of the way to allow the tube to clear the tooling. These added movements not only increase complexity and cost of the machine, but also add considerable time to the bending cycle.

Bending apparatuses have also been suggested which allow "wrinkle" bent tubes to be made which involve removing some of the grooves in the portions of the die that cause the "lockup" with the tube resulting in uncontrolled wrinkling at the extremities of the bend. Additionally, this method does not resolve the tool interference that could occur in subsequent bends.

Disclosure of Invention

The present invention provides a new and improved apparatus and method for bending tubing. In particular, the invention discloses an improved method and apparatus for forming multiple bends in a tube with the-bends being located in a variety of planes. The invention is especially suitable for making tubes used for heat exchangers in gas fired appliances. However, the invention can be utilized to bend tubes for other applications.

According to the invention, the apparatus includes a bending die substantially defining a profile of a bend to be produced in tube stock. A bending arm rotatably with the bending die is operative to bend the tube stock about the die. The bending die includes at least one fixed section and one moveable section which substantially define the shape of the bend that is to be imparted to the tube stock when the die sections are in a retracted position. The moveable die section is moveable between bend forming and bend release positions along a path that is substantially parallel to the plane of the bend. The path includes both a longitudinal and a lateral component so that the moveable die section moves relative to the fixed die section in both the longitudinal and transverse directions, as the moveable die section moves from its bend forming position to its bend release position. As a result, the bent portion of the tube is released from the bending die.

When the present invention is used to perform "wrinkle" bends, the bending apparatus includes a second moveable die section which is also moveable along a path parallel to the bend plane. The path of movement for the second die section includes at least a longitudinal component. In this embodiment, as the moveable die sections move from their tube forming position to their tube release position, at least one of the moveable die sections moves towards the other moveable die sections in order to decrease the transverse distance between the moveable sections so that the bend of a tube is released from a tube forming groove that is defined by the die sections.

When the present invention is used to perform "wrinkle" bends, at least some of the die sections include wrinkle receiving recesses which receive excess material from the inside radius of the tube being bent.

According to a feature of the invention, a cam plate supports the die sections. The cam plate includes path defining structure such as cam slots which define the path of movement for the moveable die section or die sections (if two are utilized). The moveable die section includes movement control members such as cam followers which are guided by the slots and which are also engageable with a reciprocally moveable actuating lever that, in the preferred embodiment, is also guided by the cam plate. A fluid pressure operated actuator is preferably used to produce reciprocating movement in the actuating lever.

When the present invention is used to perform mandrel type bends, the bending die may comprise a fixed die section and a single moveable die section. In mandrel type bends, wrinkles are not formed and, therefore, the tube is not locked to the die. In an alternate embodiment which is used to perform mandrel type bends, a single die section is moveable along a path defined by a cam plate. The path of movement for the single moveable die section includes both longitudinal and transverse segments so that as the moveable die section is advanced towards its tube release position, it moves both longitudinally and transversely with respect to the fixed die section. The movement of the moveable die section causes the release of the tube from the tube forming groove defined by the die sections.

Additional features of the invention will become apparent and a fuller understanding obtained by reading the following detailed description made in connection with the following drawings.

Best Mode for Carrying Out the Invention

Figure 10:
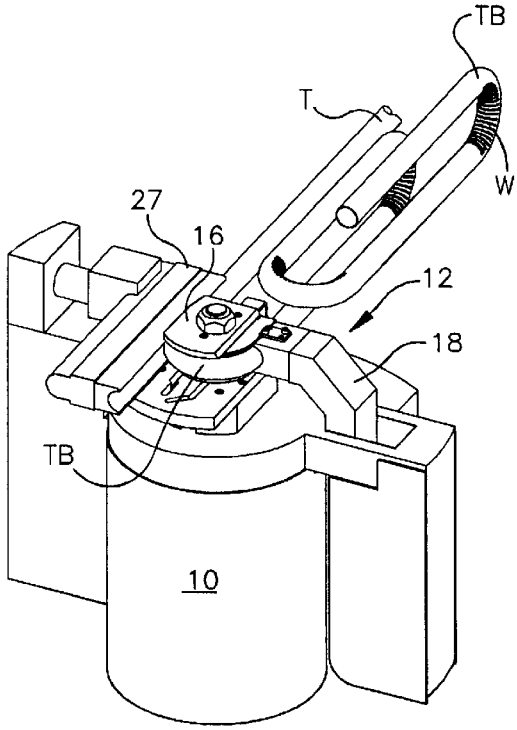
FIG. 10 is a view of the machine showing the position of certain components after a fourth bend has been made in the tube.
Figure 11:
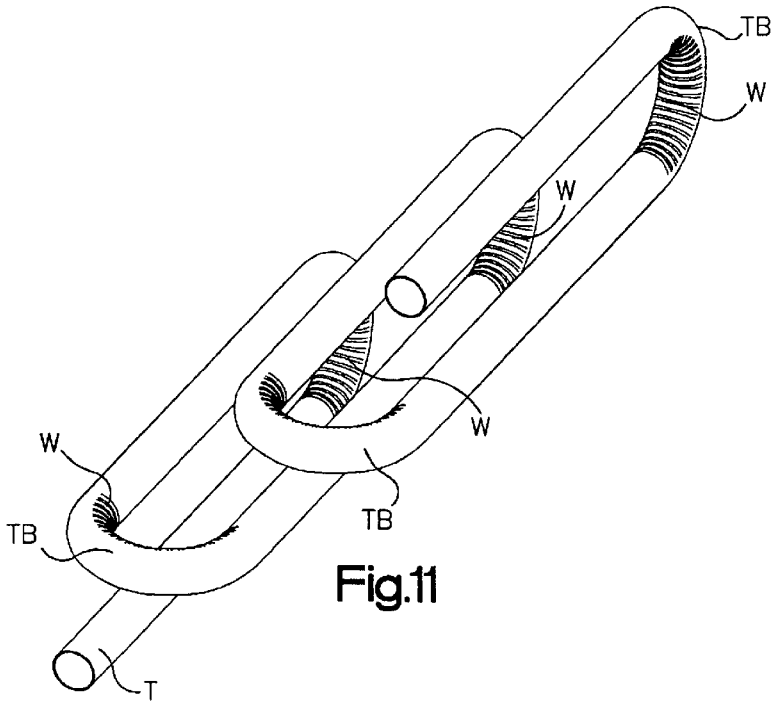
FIG. 11 is a perspective view of a finished heat exchanger tube that can be made by the machine shown in FIG. 1.

FIGS. 1–4, 6 and 8–10 schematically illustrate a tube bending apparatus constructed in accordance with the preferred embodiment of the invention. These Figures also illustrate the method by which a tube is bent into a serpentine configuration. A tube bent into the disclosed configuration is suitable for use as a tube in a heat exchanger that forms part of a gas fired appliance. The final configuration of a tube that can be formed with the disclosed apparatus and method is illustrated in FIG. 11. It should be noted that the illustrated tube includes bends located in planes that are orthogonal to each other. However, the apparatus and method disclosed is not limited to making the tube shape illustrated in FIG. 11. The method and apparatus can also be used to make tubes for applications other than heat exchangers.

Figure 1:
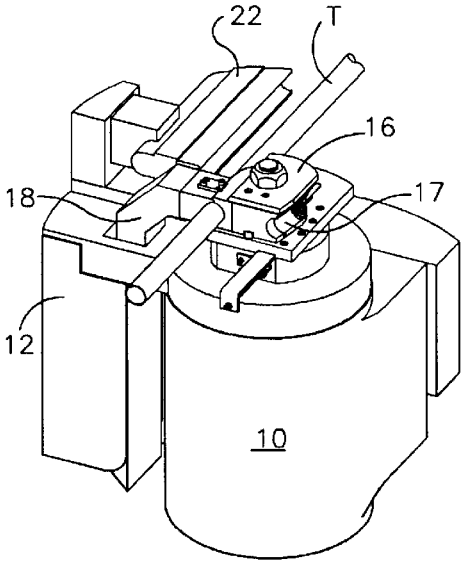
FIG. 1 is a perspective view of a tube bending machine constructed in accordance with the preferred embodiment of the invention.
Figure 2:
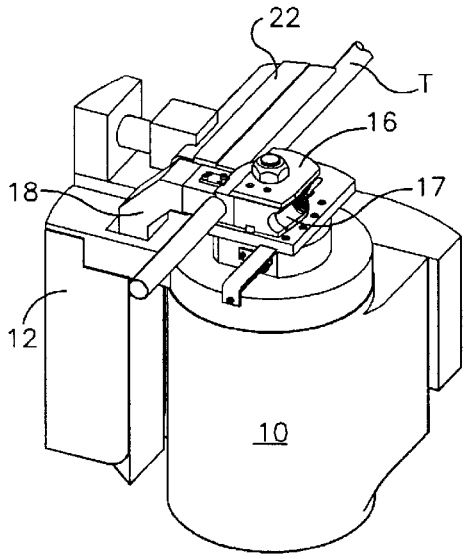
FIG. 2 is a view of the machine shown in FIG. 1 just prior to initiating a bending cycle.

Referring first to FIG. 1, the tube bending apparatus includes a base 10 which supports a bend arm indicated generally by the reference character 12. The bend arm 12 mounts a bending die indicated generally by the reference character 16 and a clamping die indicated generally by the reference character 18. The bending die 16, as seen in FIGS. 1 and 2, defines a tube groove 17 around which the tube T is bent. In general, the tube groove 17 has an inside radius that substantially conforms to the diameter of the tube stock to be bent. As should be apparent, the overall tube groove 17 forming part of the bending die 16 substantially defines the profile of the bend that will be imparted to the tube stock. In the disclosed embodiment, the bending die 16 and clamping die 18 rotate as a unit.

FIGS. 1–4 illustrate the steps that are performed by the apparatus in order to form a 180° bend in a tube T.

The clamping die 18 which forms part of the bend arm 12 is movable towards and away from the bending die 16. As seen in FIG. 1, a tube T to be bent is positioned between the bending die 16 and the clamping die 18. Although, not shown, those skilled in the art will recognize that an apparatus for automatically feeding the tube T into the position shown in FIG. 1 is well known in the art.

After the tube T has been fed to its proper position, the clamping die 18 moves towards the bending die 16 in order to clamp the tube T between itself and the bending die. A laterally movable pressure die 22 then moves against the downstream segment of the tube T being bent and provides a reaction surface and translational feed assistance for the tube as it is being bent. FIG. 2 illustrates the positions of the clamping and pressure die 18, 22 just prior to commencing the bending step.

Figure 3:
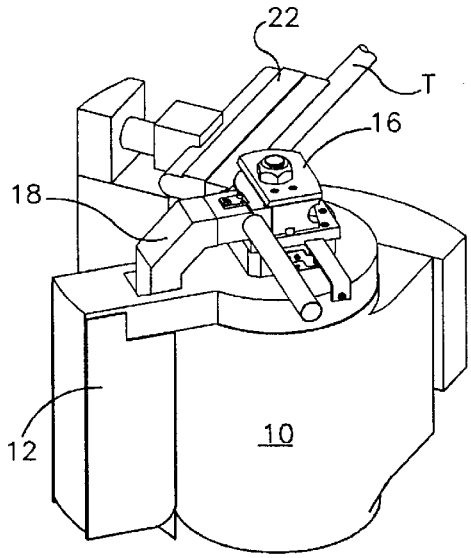
FIG. 3 is a view of the machine showing the position of certain components during a bending cycle.
Figure 4:
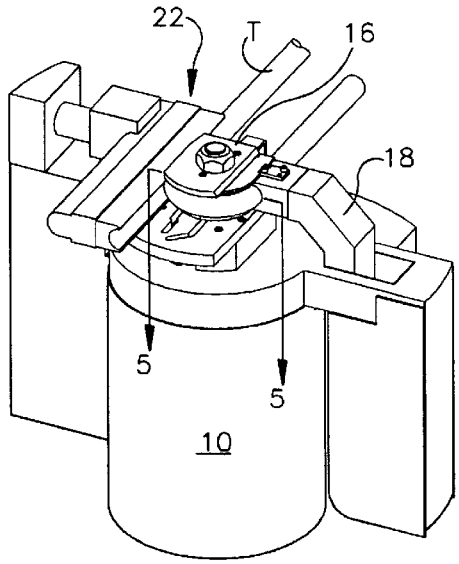
FIG. 4 is a view of the machine showing the position of certain components after a bend has been made in a tube.

As seen best in FIGS. 3 and 4, the bend arm 12 is then rotated which causes both the clamping die 18 and the bending die 16 to rotate about a vertical axis. It should be noted, as is seen in FIGS. 3 and 4, the downstream portion of the tube T is advanced as it is being bent. In order to accommodate this movement, the pressure die 22 is slidably mounted and moves with, and applies forward pressure to (in a known matter), the tube T as it is advanced during the bending step. FIG. 4 illustrates the position of the clamping die 18, bending die 16 and pressure die 22 at the conclusion of the bending step. Once the bend is completed, both the pressure die 22 and the clamping die 18 are retracted so that the tube T is no longer clamped to the bending die 16 by either the pressure die 22 or the clamping die 18.

Figure 5:
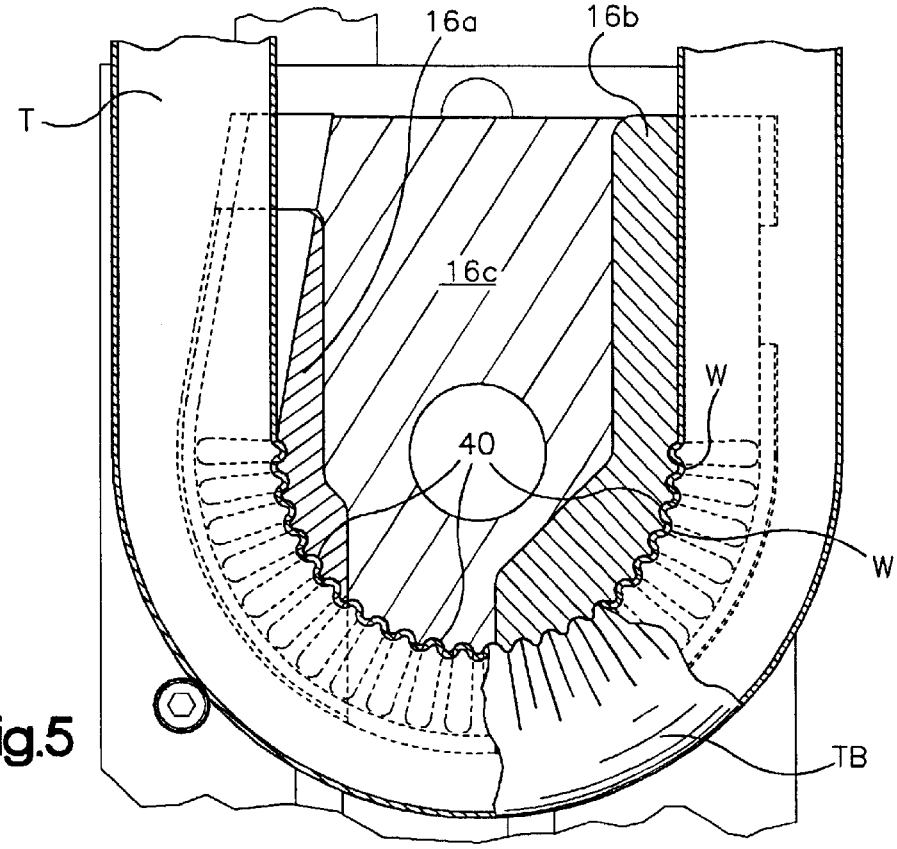
FIG. 5 is a fragmentary sectional view as seen from the plane indicated by the line 5—5 in FIG. 4.

The disclosed apparatus produces a wrinkle bend in the tube T which is best illustrated in FIG. 5. Consequently, at the conclusion of the bending step, wrinkles W formed in the bend TB of the tube T are locked to wrinkle receiving recesses or cavities 40 formed in the radiused surface of the tube groove of the bending die 16. According to the invention, the bend TB of the tube T is released from the die 16 by advancing the tube along with portions of the bending die 16. In particular, as will be explained in more detail below, the bending die 16 is segmented and includes two side segments 16*a*, 16*b* which are movable with the tube T (see FIG. 5). A center section 16*c*, to be explained, remains stationary. The die sections 16*a*, 16*b*, 16*c* each define a portion of the tube groove 17 (see FIGS. 1 and 2) and, in particular, include associated tube groove sections 17*a*, 17*b*, 17*c* (shown in FIGS. 12 and 13). Broadly stated, the side segments 16*a*, 16*b* move laterally with the tube T until the segments reach a release position at which point the side segment 16*a*, 16*b* move towards each other thereby releasing the wrinkles W in the tube from the wrinkle receiving recesses 40.

Figure 6:
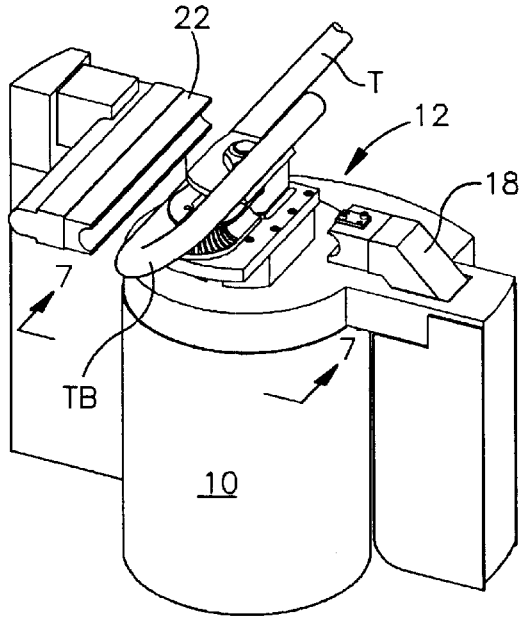
FIG. 6 is a view of the machine showing the position of certain components during a step where the tube has been released from a bending die and partially rotated over the die in order to position the tube for the next bending step.
Figure 7:
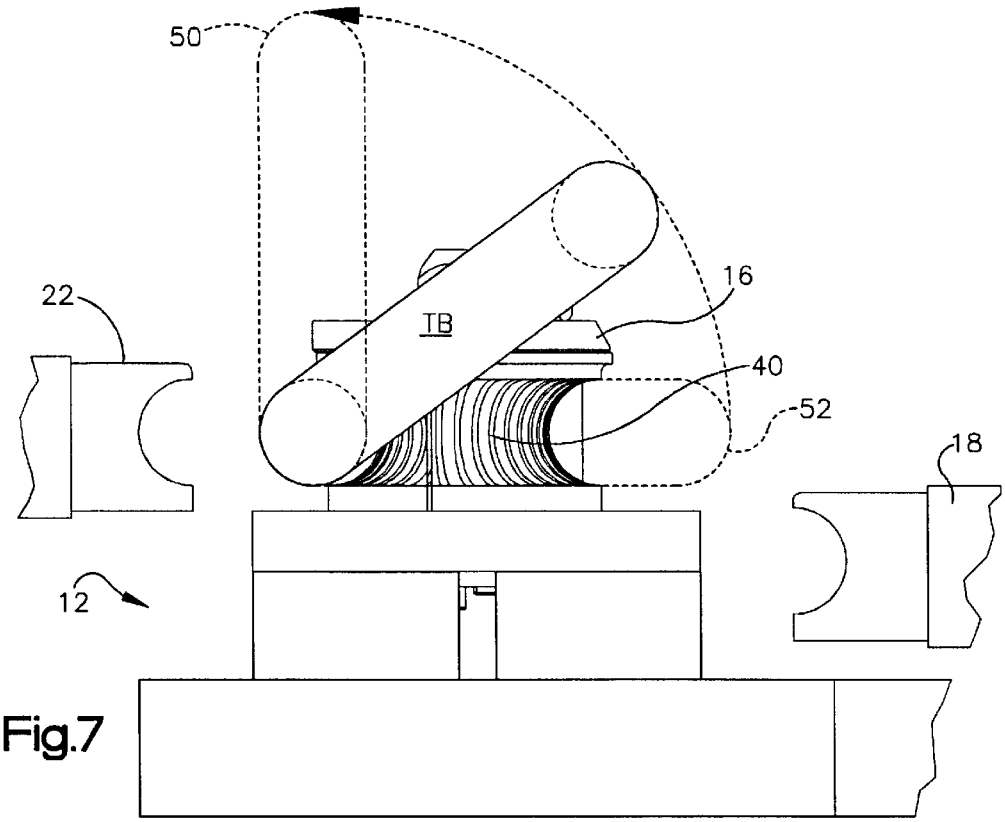
FIG. 7 is a fragmentary side view as seen from the plane indicated by the line 7—7 in FIG. 6.
Figure 8:
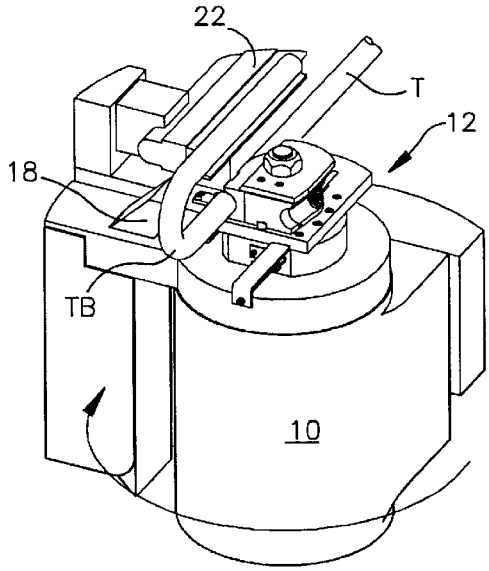
FIG. 8 is a view of the machine showing the position of certain components after the first bend has been made in a tube and just prior to initiating a second bending step on the same tube.
Figure 9:
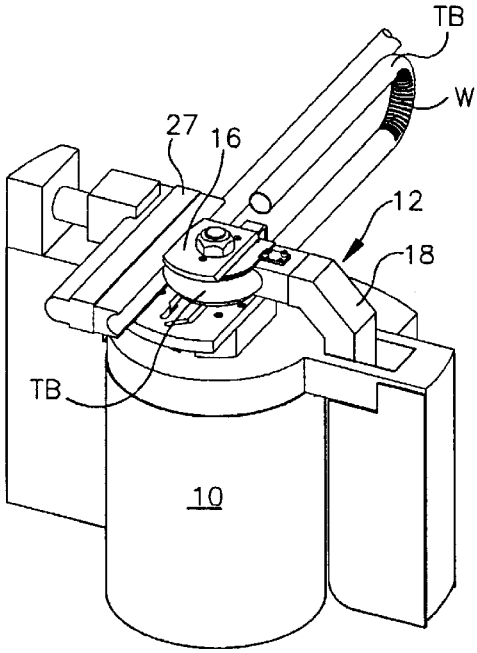
FIG. 9 is a view of the machine showing the position of certain components after the second bend has been made in the tube.

After the tube is released, the tube and jaws 16*a*, 16*b* are advanced and translated to the next predetermined bend position, the jaws stopping at their maximum extent of movement. As seen in FIGS. 6 and 7, the tube is rotated a predetermined angle (determined by the final desired configuration) to the position shown in FIG. 8. In the illustrated embodiment the tube is rotated 90° (shown in FIG. 7). Either concurrently with the rotation of the tube T or shortly thereafter, the die sections 16*a*, 16*b* are retracted by an actuator (to be described) after which the bend arm 12 counter-rotates to reposition the clamping die 18 and bending die 16 to their initial positions. The pressure die 22 is also retracted rearwardly (as viewed in FIG. 7) so that it too is returned to its initial position shown in FIG. 8. At this point, another bending step can be performed.

To perform the second bend, the clamping die 18 is again moved into clamping engagement with the tube T and the pressure die 22 is moved into abutting engagement with another downstream section of the tube to provide a reaction surface during the bending step. At the conclusion of the second bending step, the pressure die 22, clamping die 18 and bending die 16 are in the position shown in FIG. 9. As described above, the bend TB of the tube T is released from the bending die 16 by advancing it and the side segments 16*a*, 16*b* of the die 16.

The wrinkles W formed in the bend are ultimately released from the wrinkle receiving recesses 40 in the die 16 when the side segments 16*a*, 16*b* move towards each other. FIG. 10 illustrates the position of the bending apparatus and heat exchanger tube after a fourth bend has been formed in the tube T. The final configuration of the heat exchanger tube T is shown in FIG. 11. In the final configuration, the tube includes five 180° bends. In the illustrated tube, three of the bends are in a vertical plane, whereas two of the bends are in a horizontal plane, as viewed in FIG. 11.

FIG. 5 best illustrates the "locking" that occurs between the bending die 16 and the tube T. In the "wrinkle" bend method, the wrinkle receiving recesses 40 are formed on the radiused surface of the tube groove defined by the bending die 16. The wrinkle receiving recesses 40 receive the excess tube material that is created on the inside radius of the tube as a result of the bend. As is known, the outside surface of the tube tends to be stretched to accommodate the larger radius, whereas the inside surface must contract or be displaced. As a result, the bend TB formed in the tube T is locked to the bending die 16 by virtue of the engagement between the formed wrinkles W in the tube and wrinkle receiving recesses 40 in the die 16. This engagement is shown best in FIG. 5.

As seen best in FIG. 7, at the conclusion of the bending step, the pressure die 22 and clamping die 18 are moved outwardly out of engagement with the tube T. As explained above, the tube is advanced along with the side die segments 16*a*, 16*b* in order to release the bend TB of the tube T from the bending die 16. After it is released, the tube is rotated a predetermined number of degrees to the position 50 shown in phantom in FIG. 7. The final position depends on the desired configuration and in the illustrated embodiment the tube T is rotated 90°. It should be noted that because the bending die 16 is not separated along a horizontal plane as viewed in FIG. 7, it does not interfere with or prevent the rotation of the tube T from position 52 to the position 50. This rotational movement in the tube is permitted without the need for vertically split die segments or head shifting or any other movement in the bending die, other than the linear/translational movement of the die segments 16*a*, 16*b*. As will be explained, the die sections 16*a*, 16*b* move along a common plane as they are translated with the tube T and also move towards each other i.e. get closer together, thereby releasing tube bend TB from the die sections.

Turning now to FIGS. 12–17, the construction of the bending die 16 is illustrated. The components that comprise the bending die are attached to the bend arm via a base or mounting adapter 60. The adapter 60 is rigidly keyed and mounted to or forms part of the bend arm 12 and rotates therewith. The bending die 16 includes a cam/support plate 64 which includes a pair of camming slots 66, 68. The center die segment or section 16*c* is firmly attached to the cam/support plate 64 and/or the base 60. In the illustrated embodiment, the center section 16*c* is secured by a plurality of socket head bolts 70 that extend through bores 72 in the center die section 16*c* and through aligned apertures 74 in the cam/support plate 64. The bolts 70 threadedly engage bores 76 formed in the base 60.

In order to rigidly couple the base 60 to the cam plate 64 and the center die segment 16*c* and to inhibit relative rotative movement between these components when a bend is being formed, a drive key 80 is utilized. The drive key 80 concurrently engages a keyway 84 formed in the base 60, a keyway or through slot 88 formed in the cam/support plate 64 and a keyway 90 formed in the center die section 16*c*. The drive key 80 and its engagement with the three keyways/slots 84, 88, 90 ensures that the base 60, cam/support plate 64 and center die segment 16*c* rotate as a unit, even under the substantial loads and forces that are exerted on the components during the bending step.

The pair of side die segments 16*a*, 16*b* which may be termed "jaws" are located on either side of the center die section 16*c* and are supported for sliding movement along a predetermined path by the cam/support plate 64. The jaw 16*a* includes a pair of cam slot followers 94, 96 which slide in and extend through the cam slot 66. The other jaw segment 16*b* includes a cam follower 98 that slides in and extends through the other cam slot 68. The side die section 16*b* also include another cam slot follower 100 to the left of the follower 98 (as viewed in FIG. 12). In the preferred embodiment, the cam follower 100 slides in, but does not extend through the cam slot 68.

A hold down plate 102 is bolted to the center section 16*c* by a plurality of fasteners 104 and overlies portions of the moveable die segments 16*a*, 16*b*. The hold down plate 102 loosely clamps the die segments 16*a*, 16*b* to the cam/support plate 64. Appropriate clearance is provided between the underside of the hold down plate 102 and the top surfaces of the side die segments 16*a*, 16*b* so that sliding movement in the jaw sections 16*a*, 16*b* is permitted while the engagement of the cam slot followers 94, 96, 98, 100 with the respective cam slots 66, 68 is maintained.

In the illustrated embodiment, the hold down plate 102 is also held in position by a nut 105 which engages a tool post 106 that extends upwardly through the base/mounting adapter 60. The tool post 106 forms part of the illustrated bending machine. The invention is not limited to use with this type of bending machine configuration and may be easily adapted to other bending machine configurations including one that does not have the tool post 106.

In the preferred and illustrated embodiment, the bending die 16 also includes a close fitting bushing 108. The bushing 108 "registers" the center die section 16*c* with the cam plate 64. In particular, the cam plate 64 includes a bore 114 through which the tool post 106 extends. The center section also includes a bore 115 which is aligned with the bore 114 when the center die section 16*c* is mounted to the cam plate. The cam plate 64 includes a counterbore 114*a* coaxially aligned with the bore 114 sized to receive the lower portion of the bushing 108. A similar counterbore is formed on the underside of the center die section 16*c* coaxially aligned with the bore 115 which is sized to receive an upper part of the bushing. During assembly, the bushing 108 coengages the counterbores formed in the center die section 16*c* and cam plate 64 thereby registering the die section with the cam plate.

A bushing 108*a* which is the same or is substantially similar to the bushing 108 is used to register the cam plate 64 with the base 60. As seen best in FIG. 12, the bushing 108*a* engages a counterbore 122 formed on the upper side of the base 60 which is sized to receive a portion of the bushing 108*a*. A counterbore (not shown) is also formed on the underside of the cam plate 64 which is substantially similar to the counterbore 114*a* and is also sized to receive a portion of the bushing 108*a*. When the cam plate 64 is mounted to the base 60, the bushing 108*a* coengages the counterbore on the underside of the cam plate concurrently with the counterbore 122 formed in the base 60 thereby registering the cam plate 64 with the base 60. The cam plate 64 is secured to the base 60 by a plurality of bolts 123.

The jaw sections 16*a*, 16*b* are movable between tube engagement and tube released positions. The lateral, sliding movement in the jaw sections 16*a*, 16*b* is effected by a drive member 110 which is located below the cam/support plate 64 and which is slidably supported within a track 112 formed on the underside of the plate 64. The track or slot 112 confines the drive member 110 so that it moves in a rectilinear fashion along a predetermined path. An actuator 120 which, in the preferred embodiment, is an air cylinder, effects reciprocating movement in the drive member 110 with respect to the cam/support plate 64. The drive member 110 includes an elongate, lateral slot 110*a* and two smaller spaced apart slots or enlarged apertures lob. The elongate, lateral slot 110*a* is adapted to receive the cam follower 98 of the jaw section 16*b*. The enlarged apertures 110*b* are adapted to receive respective cam slot followers 94, 96 of the jaw section 16*a*.

The cam followers 94, 96 of the jaw 16*a* ride in the cam slot 66 formed in the cam/support plate 64, whereas the cam followers 98, 100 of the jaw section 16*b* ride in the cam slot 68. As described above, the cam followers 94, 96 and 98 extend through the respective cam slots 66, 68 and engage the associated slot/apertures 110*a*, 11*b* in the drive member 110. If the drive member 110 is moved towards the right, as viewed in FIG. 12, the jaw sections 16*a*, 16*b* will also move to the right along their respective cam slots 66, 68 by virtue of the engagement between the cam followers 94, 96, 98 and the slot/apertures 110*a*, 110*b*. However, the cam slots 66, 68 define a converging path of movement which cause the jaw sections 16, 16*b* to move towards each other as they move to the right.

Figure 12:
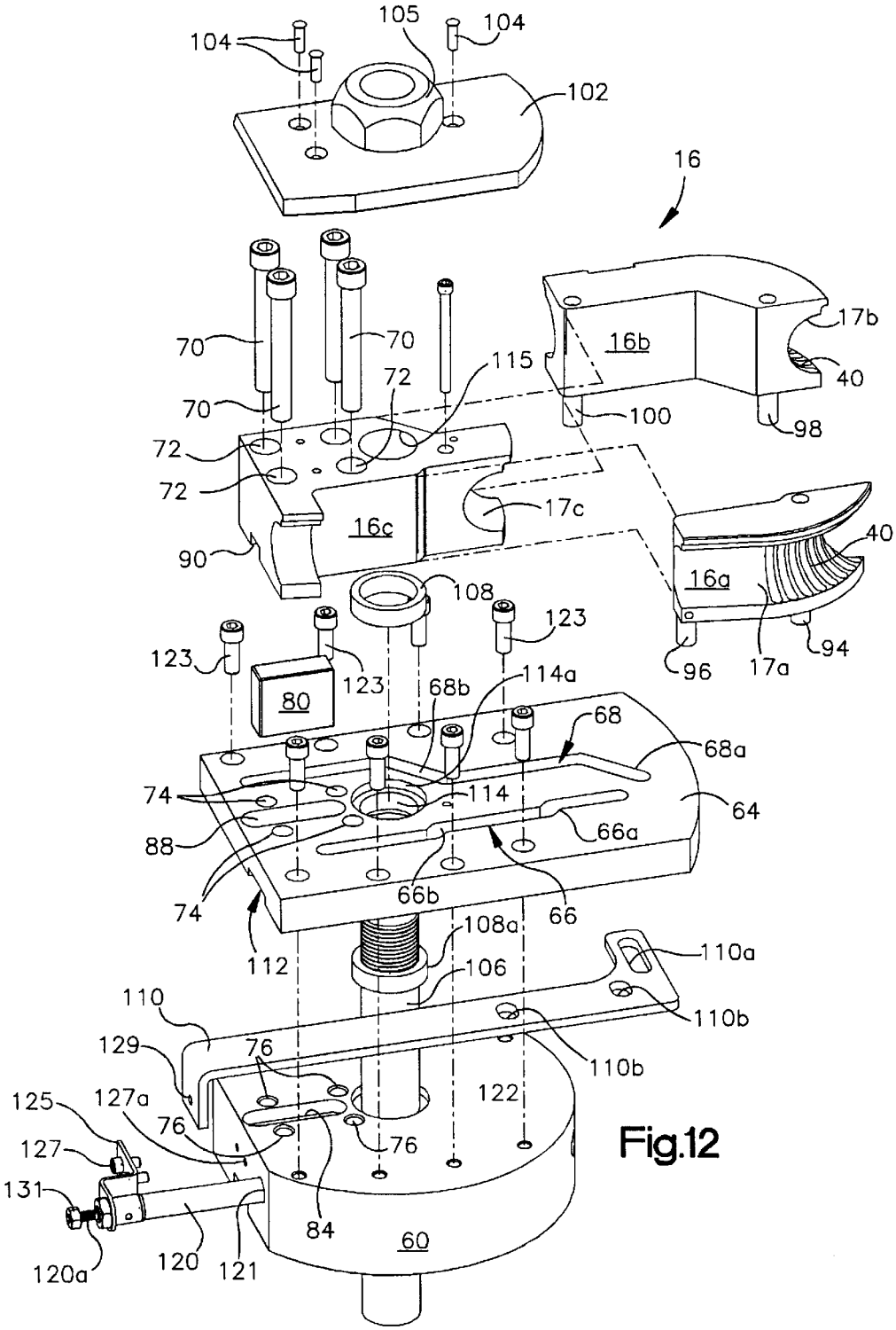
FIG. 12 is an exploded view of the bending die assembly constructed in accordance with the preferred embodiment of the invention.
Figure 13:
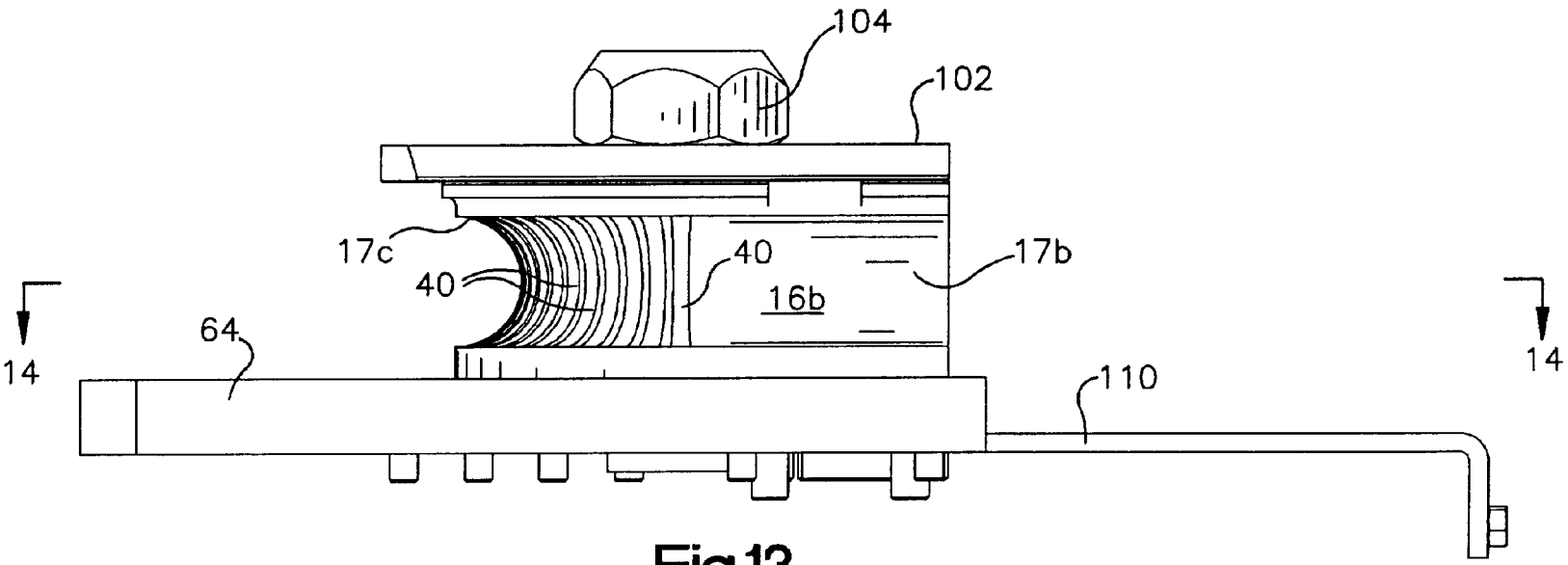
FIG. 13 is a fragmentary, side view of the bending die assembly.

Each cam slot includes a segment or segments which cause the jaw sections 16*a*, 16*b* to move towards each other. As seen in FIG. 12, the cam slot 66 includes a segment 66*a*, 66*b* which jog the jaw 16*a* towards the center of the cam/support plate as the jaw 16*a* moves towards the right as viewed in FIG. 12. The cam slot 68 includes segments 68*a*, and 68*b* which move the jaw 16*b* inwardly as it is advanced. In the preferred embodiment, the cam slot segments 68*a*, 68*b* are angled inwardly and as a result the jaw 16*b* travels a substantial distance inwardly i.e. towards the jaw 16*a*. This converging of the jaw segments as they are advanced with the bent tube, cause the jaw sections to release the wrinkles W in the tube TB from the wrinkle receiving recesses 40.

Figure 14:
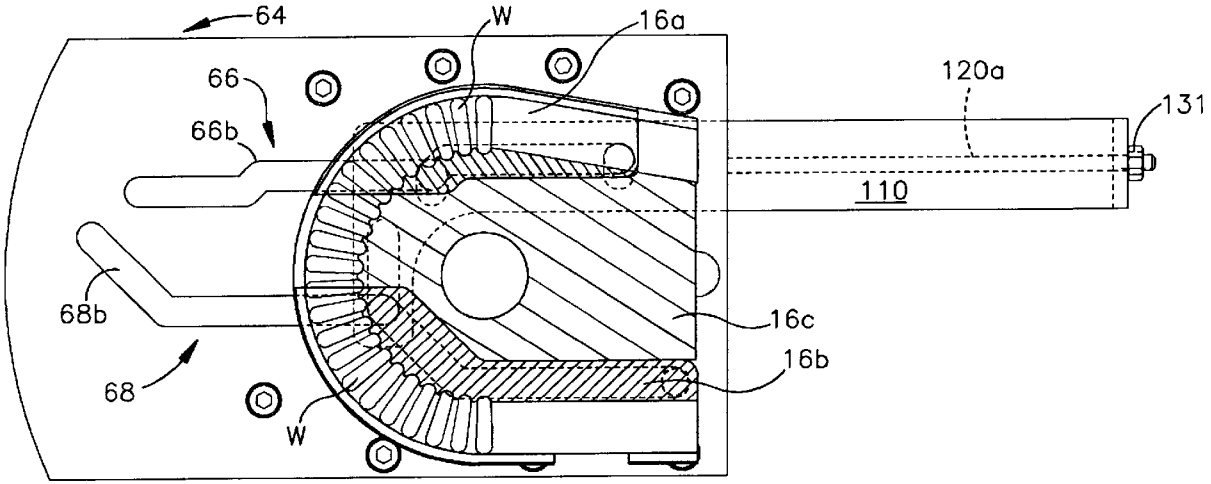
FIG. 14 is a sectional view of the bending die assembly as seen from the plane indicated by the line 14—14 in FIG. 13.
Figure 15:
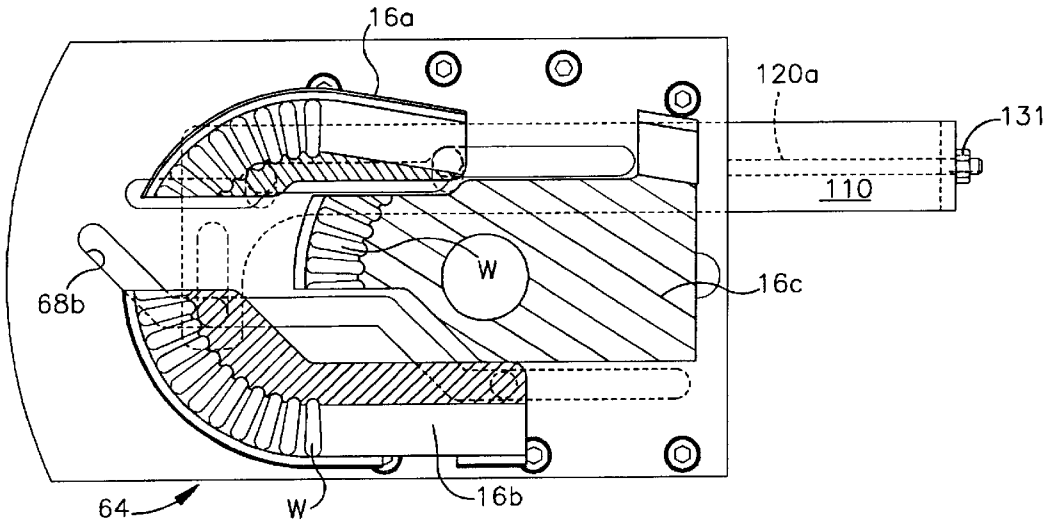
FIG. 15 is a view of the bending die assembly shown in FIG. 14 with certain die portions shown in a partially advanced positions.
Figure 16:
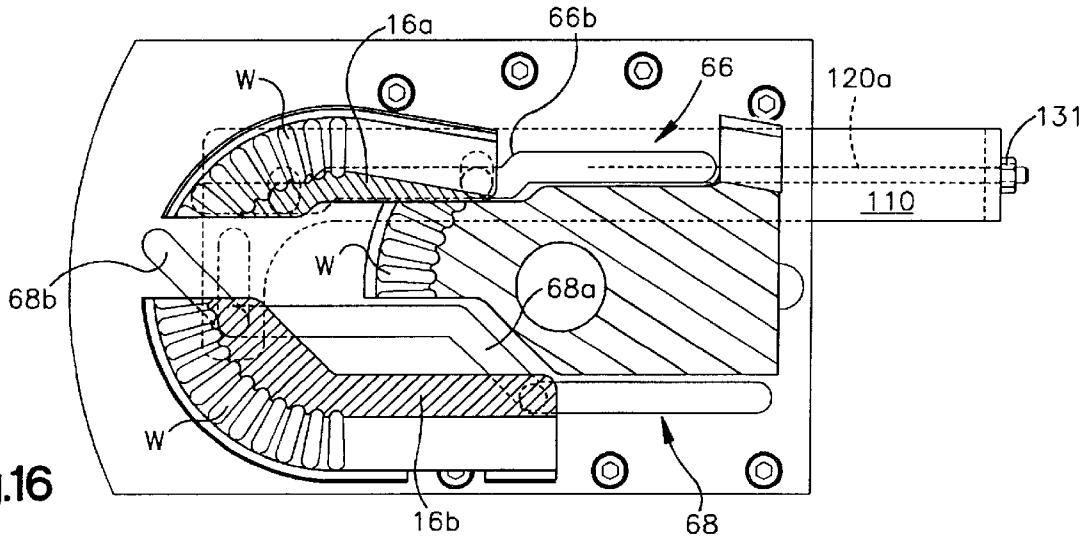
FIG. 16 is a view of the bending die assembly shown in FIG. 15 showing certain die segments advanced to further positions.
Figure 17:
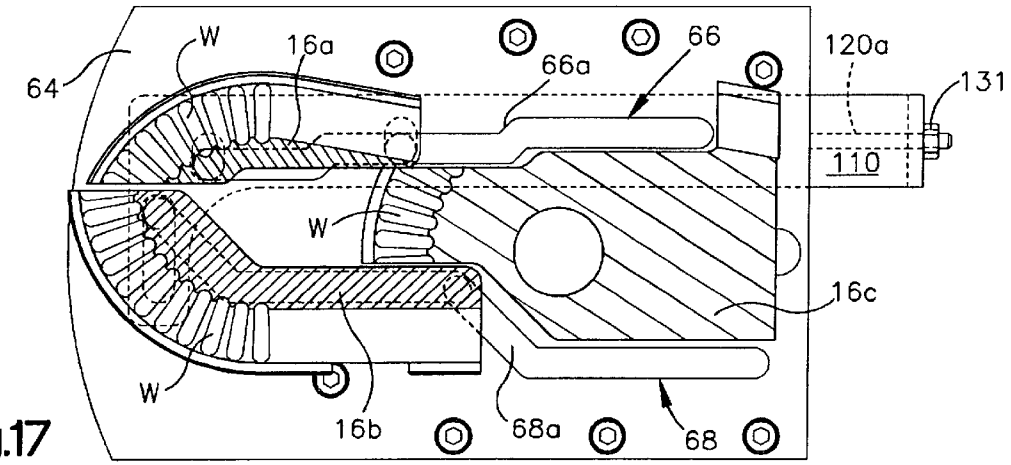
FIG. 17 is another view of the bending die assembly shown in FIG. 15 with moveable die segments shown in their fully advanced positions.

The movement of the jaw sections 16*a*, 16*b* with respect to the fixed center section 16*c* is best illustrated in FIGS. 14–17. In FIG. 14, the jaw sections 16*a*, 16*b* are in their bending positions, immediately adjacent the center section 16*c* and are fully retracted along the cam slots 66, 68. In FIG. 15, the side sections 16*a*, 16*b* have advanced along a linear path, but have not yet begun moving towards each other. In FIG. 16, the jaw section 16*a* has been jogged inwardly by the cam slot sections 66*a*, 66*b*, but the jaw section 16*b* has not yet moved inwardly. In FIG. 17, the jaw sections 16*a*, 16*b* have moved to the end of their respective cam slots and the jaw section 16*b* has moved a substantial distance towards the jaw section 16*a* along the slot segments 68*a*, 68*b*.

The actuator 120 is received in a bore 121 machined in the base 60. The actuator 120 is held to the base 60 by a bracket 125 which is secured to the body of the actuator 120. A distal end of the bracket 125 is secured to the base 60 by means of threaded fasteners 127 which threadedly engage a pair of threaded bores 127*a* formed in the base 60. The actuator 120 includes a reciprocally movable actuating rod 120*a* (shown best in FIGS. 14 and 15) which terminates in a threaded segment. The segment extends through an aperture 129 (shown best on FIG. 12) formed in the drive member 110 and is secured thereto by a nut 131. As should be apparent, reciprocating movement in the actuating rod 120*a* produces attendant reciprocating movement in the drive member 110.

In the preferred embodiment, the rod 120*a* may be extended and retracted by fluid pressure, i.e., air pressure. The invention, however, contemplates other devices, such as return springs for retracting the movable die segment. In an alternate embodiment, the movable die segments 16*a*, 16*b* are advanced with the tube (the tube is advanced at the conclusion of a bend cycle by a feed apparatus or carriage which forms part of the tube bending apparatus and which is well known in the art). Because the movable die segments 16*a*, 16*b* are locked to the tube by virtue of the wrinkles formed during the bending step, they move with the tube. However, as the die segments move along the path defined by the cam slot 66, 68 they begin to move laterally, away from the inside of the tube, once the segments 16*a*, 16*b* clear the fixed center section 16*c*. Eventually, this lateral movement causes the die segments 16*a*, 16*b* to disengage from the tube. A spring or spring device attached to the drive member 110 would then be operative to cause the die segments 16*a*, 16*b* to be returned to their retracted position in preparation for the next bend cycle.

In the alternate embodiment, the spring device may be a tension spring, one end of which is attached to the drive member 110, i.e., secured to the drive member by means of the aperture 129. The other end of the spring would be suitably attached to the base 60. In another alternate embodiment, the actuator 120 can be used as a fluid spring. In this alternate embodiment, the rod end of the actuator 120 would be constantly pressurized so that the air in the cylinder acts as a fluid spring. With this embodiment, the movable die segments 16*a*, 16*b* would be advanced with the tube as it is advanced by the tube feeding apparatus. The air within the cylinder would bias the segments toward the retracted position, but would not apply sufficient force to inhibit the die segments 16*a*, 16*b* from being advanced as the tube is advanced. However, once the die segments 16*a*, 16*b* disengage the inside of the tube, the air under pressure in the actuator 120 would serve as a spring to apply a force to the die segments 16*a*, 16*b* urging them to their retracted positions.

Figure 19:
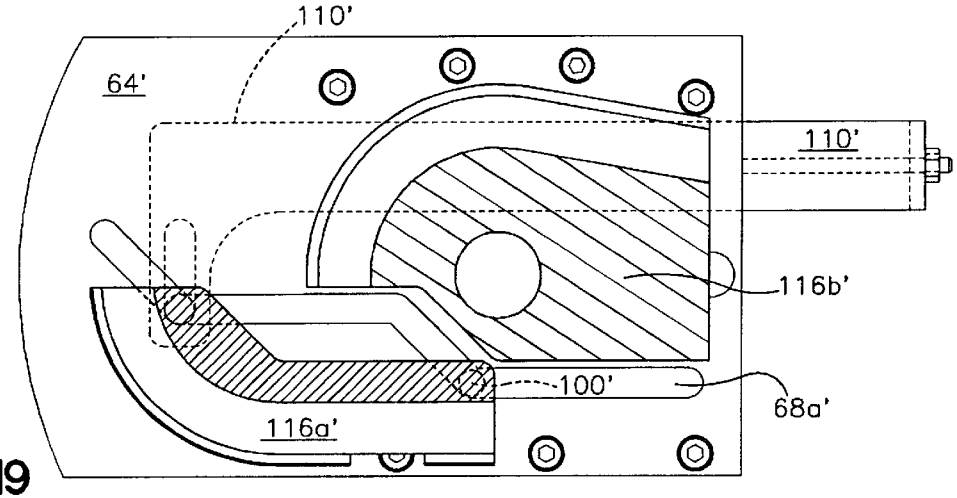
FIG. 19 is a top plan view, partially in section, of a bending die assembly constructed in accordance with an alternate embodiment of the invention, showing a moveable die segment in a partially advanced position; and, FIG. 20 is a view of the die assembly shown in FIG. 19 with the moveable die section shown in a fully advanced position.
Figure 20:
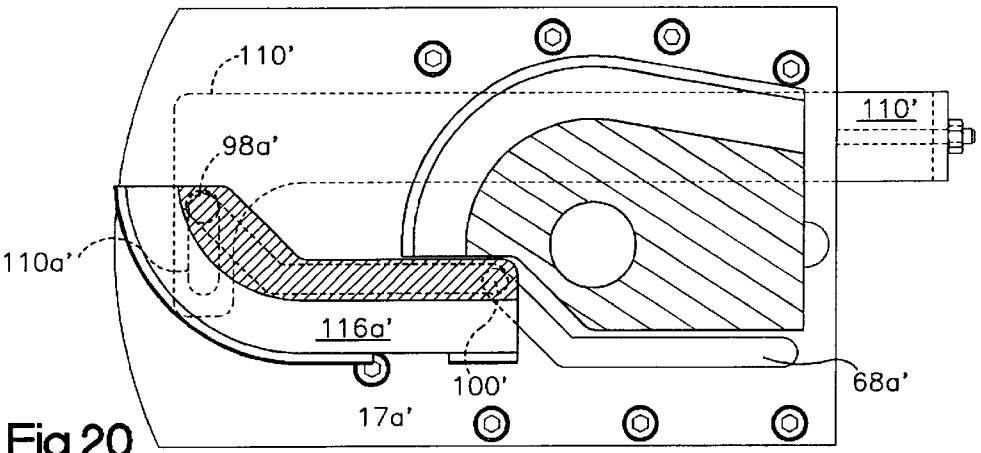
Figure 18:
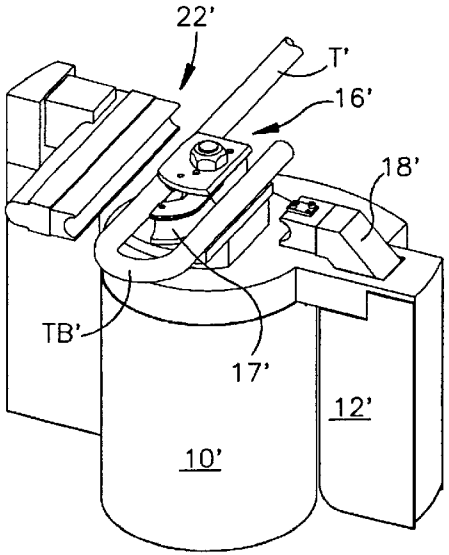
FIG. 18 is a perspective view of a machine constructed in accordance with an alternate embodiment of the invention.

FIGS. 18–20 illustrate an alternate embodiment of the invention. In an alternate embodiment, a bending die 16' is provided which is adapted to perform "mandrel" type bends in tube stock. As is known, in a mandrel method for bending tubes a device (not shown) usually termed a mandrel is inserted inside the tube in the region where the bend is to be formed. The mandrel may be in the form of interconnected rollers or balls which fill the inside space of the tube so that as it is bent, the mandrel resists deformation or wrinkling of the tube wall. After the tube is bent, the mandrel is withdrawn. As a result, with mandrel type bends, wrinkles are not formed on the inside radius of the tube bend and consequently, the tube is not locked to the bending die 16' by wrinkles.

FIG. 18 schematically illustrates the operation of the alternate embodiment. To facilitate the explanation, components which are similar to the components described in connection with the first embodiment, will be given the same reference character followed by an apostrophe.

The mandrel type bending apparatus includes a base 10' which supports a bend arm indicated generally by the reference character 12'. The bend arm 12' mounts a bending die 16' constructed in accordance with this alternative embodiment and a clamping die 18'. In the alternate embodiment, the bending die 16' and clamping die 18' also rotate as a unit. The bending apparatus also includes a clamping die 18' and a moveable pressure die 22' which operate in the same manner as the clamping die 18 and pressure die 22 forming part of the first embodiment.

FIG. 18 illustrates the step of the bending process where a tube T' has been bent about the bending die 16' and has been advanced to a released position.

According to the alternative embodiment, the bending die 16' includes a moveable section 116*a* and a fixed section 116*b* (shown best in FIGS. 19 and 20). Preferably, the sections 116*a*, 116*b* do not include wrinkle receiving cavities. The fixed section 116*b* is mounted to a cam plate 64' and is preferably secured in the same manner that the fixed section 16*c* of the first embodiment is secured. The moveable section 116*a* is slidable on the cam plate 64' along a path defined by a guideway or cam slot 68*a*'. The slot 68*a*' may be substantially similar to the slot 68*a* of the first embodiment (see FIG. 12). The moveable section 116*a* includes a pair of cam followers 98*a*', 100' that slide within the cam slot 68*a*'. The cam follower 98*a*' is engageable with a slot 110*a*' forming part of an actuating lever 110' that operates substantially similar to the actuating lever 110 of the first embodiment (see FIG. 12). An actuator 120' operates the actuating lever 110'.

Because wrinkles are not formed in the tube T' during the mandrel bending operation, a single moveable die section, i.e, section 116*a*, is all that is needed in order to release the bend TB' of the tube T' from the bending die 16'. Since the tube T' is not locked to wrinkle receiving recesses the tube T' can be initially advanced relative to the fixed die section 116*a*. The moveable die section 116*a* (which is also advanced with the T') is then moved transversely with respect to the fixed die section 116*b* in order to release the tube T' from a tube forming groove segment 17*a*' forming part of the moveable die section 116*a* (see FIG. 20). Once it is released by the moveable die section 116*a*, it can be rotated about its axis in order to perform another bending step on the tube T'.

It should be noted that the disclosed apparatus and method have been optimized for making 180° bends in tubes. It should be understood, however, that the principles of this invention can be adapted to produce bends in tubes other than 180°. Changes and modifications to disclosed apparatus and method that would be needed in order to utilize the invention to produce bends other than 180° would be apparent to those skilled in the art. Accordingly, the present invention should not be limited to an apparatus and/or method for making 180° bends in tubes.

Although the invention has been described with a certain degree of particularity, it should be understood that those skilled in the art can make various changes to it without departing from the spirit or the scope of the invention as hereinafter claimed.

We claim:

1. A bending die assembly for producing bends in tubes, comprising:

a) a bend die including a fixed section rigidly mounted to a support member and a pair of movable die sections, movable relative to said fixed die section and relative to each other along a predetermined path;

b) said movable die sections supported for movement in a common bend plane; and, c) movement control members for controlling the path of movement for each of said die sections.

2. The bend die assembly of claim 1, wherein said movable die sections include camming pins engageable with slots formed in said support member, such that the engagements of said pins with said associated slots define paths of movement for said die sections.

3. The bend die assembly of claim 2, wherein said moving die sections and said fixed die sections define a bend radius about which a tube is bent when said movable die sections are in a retracted position.

4. The bend die assembly of claim 3, wherein said fixed die section and said movable die sections define wrinkle receiving recesses in their respective bending surfaces for accepting material from a tube that is bent about said die when said movable die sections are in their retracted positions.

5. The bend die assembly of claim 1, further comprising an actuator for advancing said die segments after a bending step, such that said segments move relative to said fixed die section and relative to each other.

6. Apparatus for producing bends in tube stock, comprising:

a) a bend die substantially defining the profile of the bend to be produced in the tube stock;

b) a bending arm rotatable with said bending die and operative to bend said tube stock about said bending die;

c) said bending die including at least one fixed section and at least one moveable section which substantially define the shape of the bend to be imparted to the tube stock, when said section is in its retracted position;

d) said moveable die section moveable between bend forming and bend release positions, along a path that is substantially parallel to a plane of said bend; and, e) said path including both a longitudinal and lateral components such that said moveable die section moves relative to said fixed die segment as said moveable die section moves from its bend forming position to its bend release position in both longitudinal and transverse directions whereby a bent portion of said tube is released from said bending die.

7. The bending apparatus of claim 6 wherein:

a) said bending die includes a second moveable section also moveable along a path parallel to said bend plane, said path of movement for said second moveable portion including at least a longitudinal component; and, b) said first moveable die section moves towards said second moveable section as said first moveable section moves from its bend forming position to its bend release position.

8. The apparatus of claim 7 wherein said die sections include wrinkle receiving recesses for receiving excess material generated as said tube stock is bent around said die.

9. The apparatus of claim 6 wherein said die sections are supported on a cam plate and said moveable die section includes cam followers and engageable with a cam slot formed in said cam plate which defines the path of movement for said moveable die section.

10. The apparatus of claim 9 wherein said cam plate defines a guideway for an actuating lever which is operative to drive said moveable die section between said bend forming and bend release positions and said apparatus further includes a fluid pressure operated actuator for driving said actuating lever.

11. A method for producing bends in tube'stock, comprising the steps of:

a) providing a bend die defining the profile of a bend to be produced in a length of tube stock;

b) advancing said tube stock to a predetermined bend position;

c) engaging a down stream portion of said tube with a bending arm and rotating said bending arm through a predetermined arc of rotation with respect to said bending die such that said tube is caused to substantially conform to the bend profile defined by said die; and, d) advancing at least one portion of said bending die in a generally down stream direction along a path that includes a transverse component such that said moveable die section moves both in a down stream direction and towards said fixed die section.

* * * * *